United States Patent [19]

Arad et al.

[11] 4,009,831

[45] Mar. 1, 1977

[54] COMBINED SHOWER HEAD AND DISPENSER

[76] Inventors: Avi Arad, 165 E. 66th St., New York, N.Y. 10022; William Stephens, 2 Cinder Lane, Hicksville, N.Y. 11801

[22] Filed: Sept. 10, 1975

[21] Appl. No.: 611,910

[52] U.S. Cl. ..... 239/315

[51] Int. Cl.² ..... B05B 7/24

[58] Field of Search ..... 239/315, 316, 310

[56] References Cited

UNITED STATES PATENTS

| | | | |
|---|---|---|---|
| 2,325,758 | 8/1943 | Ferguson | 239/315 X |
| 3,367,580 | 2/1968 | Hronas et al. | 239/315 X |
| 3,777,982 | 12/1973 | Britton | 239/315 |
| 3,788,553 | 1/1974 | Heckman | 239/315 |

*Primary Examiner*—John J. Love
*Attorney, Agent, or Firm*—Amster & Rothstein

[57] ABSTRACT

An apparatus is provided which is adapted to be connected in communication with a single stream of water and which is constructed and arranged to divide the single stream of water into a plurality of streams of water. The apparatus defines a fluid stream through a fluid chamber into a mixing chamber and forms the plurality of streams by directing the water through a foraminous nozzle member. The apparatus also includes an additive chamber adapted to contain an additive and includes provision for mixing some of the water with the additive in the additive chamber and supplying the mixture of additive and water to the mixing chamber for formation, along with the plain water, into a plurality of streams of water through the foraminous nozzle, each containing the same amount of additive. The apparatus includes means for selectively controlling the introduction of water mixed with additive into the mixing chamber through rotation of the foraminous nozzle between normal and additive-blocking positions.

2 Claims, 6 Drawing Figures

COMBINED SHOWER HEAD AND DISPENSER

The present invention relates generally to valves, and in particular, to a shower head including a valve designed for selective dispensing of an additive.

Various shower heads have been available in the marketplace for many years. Typically, the shower heads which have been available include means for removably fixing the shower head at an upstream end thereof to a single stream of fluid, usually water. A pressure chamber is generally located downstream of the shower head-fixing means and forms a shower head body member. A foraminous nozzle member typically closes the downstream end of the body member with the foramina of the foraminous nozzle member communicating the interior of the body member with the exterior thereof.

The foramina of the foraminous nozzle member serve to produce the plurality of streams of fluid which exit from the shower head having been formed from the single entering stream of fluid. The exiting plural streams of fluid are increased in pressure relative to the single incoming stream of fluid and thereby provide a desired cleaning or massage effect to the user of the shower head.

For some time it has been recognized that at various times and under varying circumstances, it is either desirable or necessary to mix certain material or additives of one kind or another with the water which exits from the foraminous nozzle of a shower head.

For example, if the shower head is to be used in areas having water with a high mineral content (so-called "hard"water), it may be necessary or desirable to add a water-softening agent to the water which exits from the foraminous nozzle. The addition of a water-softening agent not only may prevent clogging of the foramina but will also greatly facilitate the production of lather with water from the shower head when the same is mixed with the softener additive.

In addition or at other times it may be desirable to add perfumes and/or emollients or even deodorant to the water which exits from the shower head.

Naturally, it is desirable to be able to control the dispensing of the additive both to conserve the additive and to be able to supply additive-free water when desired, for example, for rinsing.

Over the years, various apparatus has been made available for selectively dispensing an additive into a stream of water which exits from a shower head. For example, an apparatus exists wherein an outer housing defines a clear fluid chamber which includes therein an inner annular housing defining an inner, additive-containing chamber completely surrounded by the outer chamber. Fluid is simultaneously introduced into the outer non-additive-containing chamber and the inner additive-containing chamber. The fluid introduced into the inner additive-containing chamber exits from the apparatus through a plurality of foramina within a nozzle which caps the end of the apparatus.

In addition to not including any convenient means for introducing an additive into the additive chamber, the just-described apparatus makes no provision for mixing of the additive with the non-additive-containing water prior to exiting of the plurality of streams from the apparatus. This results in a final stream which is unsatisfactory in that it produces additive-containing water in the center of the stream and non-additive-containing water thereabout.

An apparatus such as that discussed above is shown and described in U.S. Pat. No. 2,304,867 which issued Dec. 15, 1942.

In addition, water-dispensing devices exist which provide a plurality of streams of water wherein the apparatus can selectively dispense either additive-containing water at a full rate of supply or non-additive-containing water at a full rate of supply. In addition, the last-noted apparatus is capable of dispensing a reduced-flow rate combination of additive-containing and non-additive-containing water which is somewhat combined prior to being dispensed and discharged from the apparatus. However, the last-noted apparatus, in addition to not thoroughly mixing the additive with the exiting water requires that if additive-containing water is to be dispensed, the volume of non-additive-containing water must be reduced. That last-noted apparatus does not include provision for providing non-additive-containing water at full flow and selectively introducing an additive into the exiting stream of water.

The last-noted apparatus is shown and described in U.S. Pat. No. 2,325,758 which issued Aug. 3, 1943.

It is an object of the present invention to provide an improved combination shower head and dispensing apparatus which permits providing a non-additive-containing flow of fluid at a given rate of supply and selectively introducing an additive into said fluid without substantially diminishing the given rate of supply thereof.

It is a more particular and further object of the present invention to provide an inexpensive combination shower head and dispensing apparatus which is convenient to operate and which provides a plurality of streams of fluid substantially each of which contains substantially the same amount of additive.

In accordance with an illustrative embodiment demonstrating objects and features of the present invention, there is provided an apparatus for producing a plurality of streams of fluid from a supply of fluid and for selectively introducing a substantially equal amount of additive into each of the streams of fluid. The apparatus comprises a main body member having an upstream end and a downstream end. A fluid inlet member is provided and means are provided for mounting the fluid inlet member on the main body member at the upstream end thereof. The fluid inlet member includes means which are constructed and arranged for attachment of the apparatus to a source of supply of fluid. A fluid chamber is located within the main body member and has an upstream end and a downstream end. An additive chamber is also located within the main body member and has an upstream end and a downstream end. The upstream end of the fluid chamber and the upstream end of the additive chamber are both in communication with the interior of the fluid inlet member. An access member is mounted relative to the main body member and includes means which are constructed and arranged to permit communication with the interior of the additive chamber from the exterior of the main body member for introduction of an additive through the access member into the additive chamber. A foraminous member is mounted relative to the main body member proximate the downstream end of the main body member for use in producing the plurality of streams of fluid. The fluid chamber and the additive chamber each include at least one opening in the downstream end thereof. The apparatus includes a mixing chamber proximate the downstream end of the main body member. The mixing chamber is in communication with the additive chamber and is also in communication with the fluid chamber through, respectively, the additive chamber and fluid chamber downstream end openings. The mixing chamber also is in communication with the foraminous member. The apparatus includes means which are constructed and arranged to define a fluid path from the fluid inlet member through the fluid chamber and into the mixing chamber. The apparatus further includes means which are constructed and arranged to define an additive path from the fluid inlet member through the additive chamber and into the mixing chamber. The apparatus further includes means which are constructed and arranged to thoroughly mix the fluid and the additive in the mixing chamber. The apparatus also includes additive control means located in the additive path for selectively interrupting the flow of additive from the additive chamber along the additive path thereby selectively permitting passage of substantially only the fluid through the foraminous member and selectively permitting passage of a thoroughly dispersed mixture of the additive and the fluid through the foraminous member.

The above brief description as well as further objects, features and advantages of the present invention will be more fully understood by reference to the following detailed description of a presently preferred but nonetheless illustrative embodiment in accordance with the present invention, when taken in conjunction with the accompanying drawing, wherein.

Figure 1:
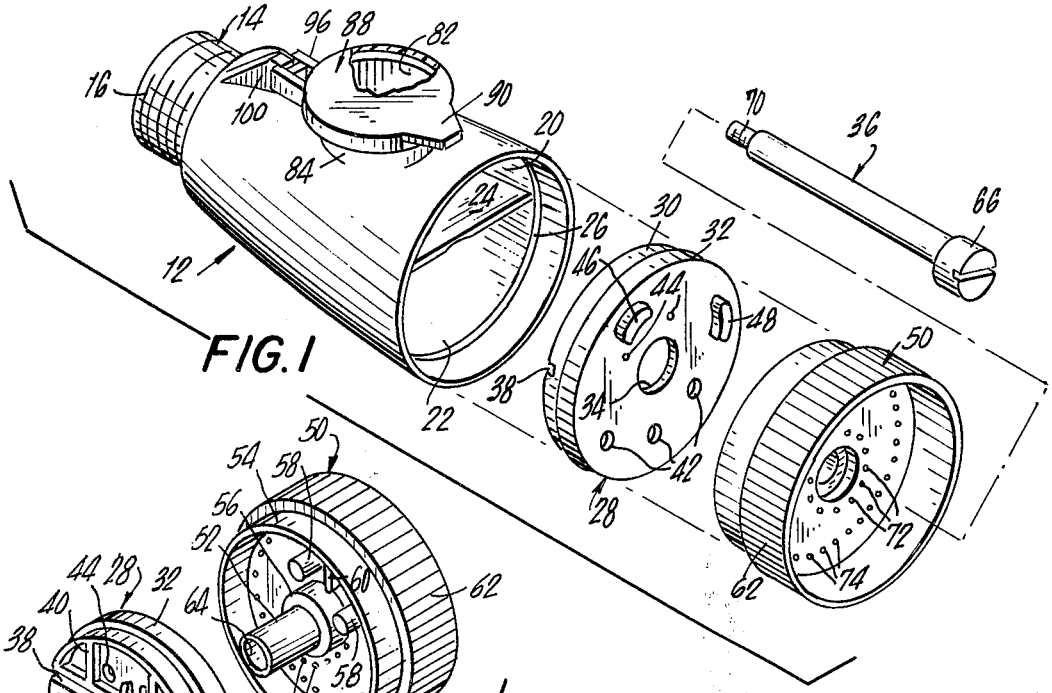
FIG. 1 is an exploded right perspective view of a representative form of the present invention with a foraminous nozzle and mixture control member, a chamber cap member and a main body member shown in registration.
Figure 4:
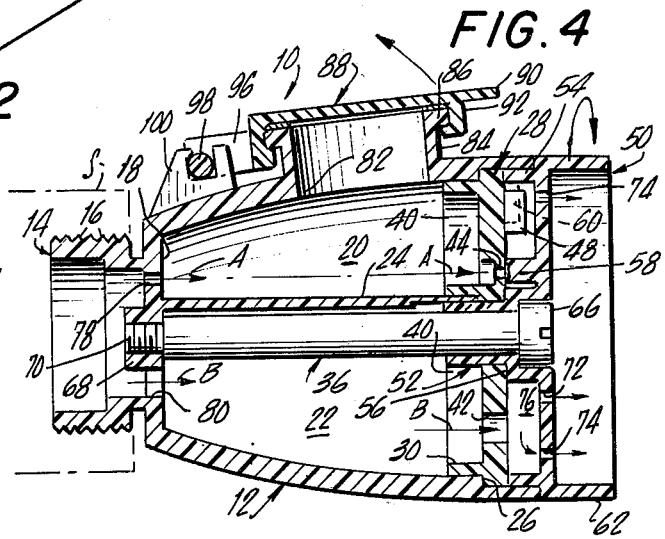
FIG. 4 is a front elevational view of the representative form of the present invention shown in FIG. 3 taken substantially along the line 4—4 of FIG. 3 and looking in the direction of the arrows.

Referring now specifically to the drawing and first to FIGS. 1 and 4, there is shown a combination shower head and dispensing apparatus illustrative of the present invention which is generally designated by the reference numeral 10 and which includes a main body member 12 which may be fashioned of any suitable material in any convenient manner and which, in the present embodiment, is molded of plastic.

At the left-most or upstream end of the shower head and dispenser 10 is a fluid inlet member 14 which is fixed to the left-most or upstream end of the main body member 12 (and in the preferred embodiment is formed as one piece therewith).

The fluid inlet member 14 includes exterior threads 16 within the exterior surface thereof. The threads 16 are constructed and arranged to be received within a standard shower head coupling member S, shown in phanton in FIG. 4. The shower head coupling member S is, in the conventional manner, affixed on the end of a supply of fluid such as water, typically connected to the hot and cold water system, for example, in a dwelling.

Figure 6:
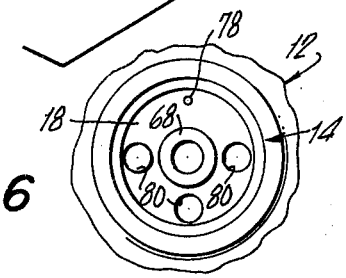

The main body member 12 is generally frusto-conical in exterior configuration and includes a relatively plane upstream end wall 18 closing its upstream end (see FIGS. 4 and 6). The interior of the main body member 12 is divided unequally into an upper, smaller, additive chamber 20 and a lower, larger fluid chamber 22 by an axially extending interior dividing wall 24. The dividing wall 24 extends transversely or radially to intersect the interior of the main body member (see FIG. 1) and extends longitudinally or axially from the point of intersection with the upstream end wall 18 to a point within the interior of the main body member 12 located upstream of the right-most or downstream end of the main body member. The downstream point of termination of the dividing wall 24 is at an axial location wherein the interior radial dimension of the main body member 12 enlarges at a radially outwardly extending step or shoulder 26 (see FIGS. 1 and 4).

In view of the direction of travel of water through the apparatus 10, the left side of the drawing is, in general, the upstream side thereof and the right side of the drawing is, in general, the downstream side thereof.

A generally cylindrical, chamber cap member 28 is located within the interior of the main body member 12 (see FIG. 4). The cap member 28 includes a first mounting flange 30 of a given diameter substantially equal in its exterior dimension to the interior dimension of the main body member 12 immediately upstream of the shoulder 26. The cap member 28 includes a second mounting flange 32 which is axially spaced from and of a second, larger diameter than the first mounting flange 30. The exterior dimension of the second mounting flange 32 is substantially equal to the interior dimension of the main body member 12 immediately downstream of the shoulder 26 (see FIG. 4).

Figure 2:
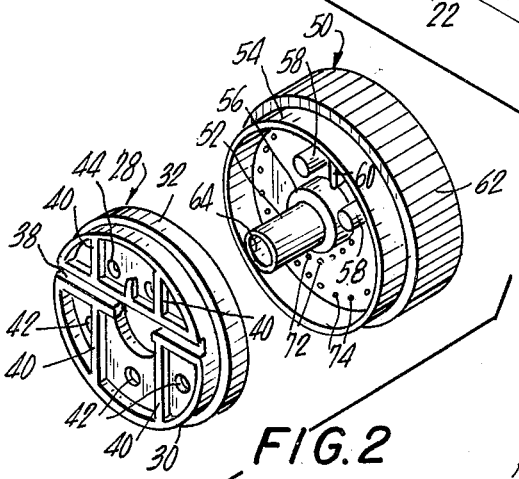
FIG. 2 is a left perspective view of the foraminous nozzle and mixture control member and chamber cap member of FIG. 1 shown in registration.

Centrally located within the cap member 28 is an axially extending opening 34 for receipt of a mounting or assembly rod 36 in a manner to be described in greater detail hereinafter. The cap member 28 also includes a transversely extending mounting slot 38 within the upstream face thereof (supported by appropriate strut members 40 as may be seen in FIG. 2). The mounting slot 38 is configured and positioned within the cap member 28 to engage the downstream end of the dividing wall 24 when the shower head and dispensing apparatus 10 is in the assembled condition as shown most clearly in FIG. 4.

As may be best seen by reference to FIGS. 1, 3 and 5, the downstream face of the relatively stationary cap member 28 includes two generally arcuate-shaped axially downstream projecting stops 46, 48 which project axially outward from the downstream face of the cap member 28 for a purpose to be described hereinafter.

A generally cylindrical, relatively rotatable foraminous nozzle and mixture control member 50 includes a hollow cylindrical mounting hub 52 centrally thereof (see FIGS. 2 and 4) which projects upstream from the upstream or interior, left-most face thereof. Spaced radially outwardly from the cylindrical mounting hub 52 proximate the outer circumference of the nozzle and mixture control member 50 is a co-axial, generally cylindrical mounting flange 54 which has an outer diameter substantially equal to the inner diameter of the main body member 12 downstream of the shoulder 26 and substantially equal to the outer diameter of the second mounting flange 32 of the cap member 28 (see FIG. 4).

As may be seen most clearly by reference to FIG. 4 when the cap member 28 is in position within the apparatus 10, it substantially completely closes the downstream end of the respective additive and fluid chambers 20, 22. The cap member 28 does include, in the part thereof below the central opening 34, three fluid chamber exit ports 42 of a given diameter. The fluid chamber exit ports 42 communicate, at their upstream ends, with the interior of the fluid chamber 22.

Located within the upper portion of the cap member 28, above the central opening 34 and in communication with the additive chamber 20, are two openings 44 of a diameter which is substantially less than the diameter of the exit ports 42 in communication with the fluid chamber 22. As may be noted by reference to FIG. 4, the reduced diameter exit ports 44 communicate at their upstream ends with the interior of the additive chamber 20.

The cylindrical mounting hub 52 includes a reduced diameter upstream section which is configured and positioned to be of the same exterior diameter as the interior diameter of the central opening 34 within the cap member 28 and which is arranged relative to the mounting flange 54 and the main body member 12 to be rotatably received within the opening 34 when the cap member 28 is fixed with respect to the shower head and dispensing apparatus 10 by being positioned as shown in FIG. 4 with the dividing wall 24 within the mounting slot 38. In the position shown in FIG. 4, the shoulder 56 of the larger diameter portion of the cylindrical mounting hub 52 abuts the downstream face of the cap member 28 and fixes the axial position of the nozzle and mixture control member 50.

Figure 3:
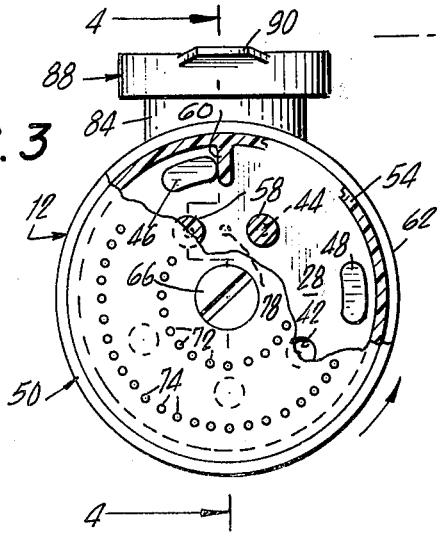
FIG. 3 is a right elevational view of the illustrative form of the present invention with parts thereof broken away and shown in section with the additive path shown interrupted or blocked.

The upstream, inner, left-most face of the nozzle and mixture control member 50 includes axially projecting generally cylindrical blocking members 58 which are located on the upstream face of the nozzle mixture control member 50 in a manner to be radially and circumferentially aligned with the additive chamber exit ports 44 in at least one rotated position of the nozzle and mixture control member 50 (see FIGS. 3 and 4).

Figure 5:
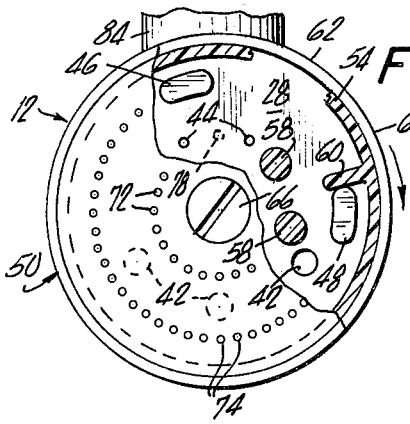
FIG. 5 is a fragmentary right elevational view of the representative form of the present invention with parts thereof broken away and shown in section, similar to FIG. 3, with the additive path shown not interrupted or blocked; and, FIG. 6 is a fragmentary left elevational view of the representative form of the present invention shown in FIG. 4.

Also projecting axially outward and upstream from the upstream face of the nozzle and mixture control member 50 is a radially inwardly projecting ear 60 which projects radially inwardly an amount sufficient to permit contact of the ear 60 with the stops 46, 48 when the shower head and dispensing apparatus 10 is in the assembled condition as shown in FIGS. 3, 4 and 5, for a purpose to be described hereinafter.

The radially outermost portion of the rotatable nozzle and mixture control member 50 is an operating collar 62 which includes raised ridges on the surface thereof to aid in rotation of the rotatable nozzle and mixture control member 50 in a manner and for a purpose to be described in detail hereinafter. An opening 64 is centrally located within the nozzle and mixture control member 50 and continues through the transverse, face or wall thereof and through the cylindrical mounting hub 52.

The opening 64 is sized to accept the exterior diameter of the central part of the mounting or assembly rod 36. The opening within the transverse face of the nozzle and mixture control member 50 and the opening within the larger diameter portion of the cylindrical mounting hub 52 are enlarged relative to the opening 64 in the manner of a countersunk opening to accept the enlarged, slotted head 66 of the assembly rod 36.

As may be noted by reference to FIG. 4, the center of the upstream end wall 18 of the main body member 12 includes an upstream mounting projection 68 which is internally threaded. The projection 68 is adapted to receive the male threads on the threaded upstream, left-most end portion 70 of the mounting or assembly rod 36 when the shower head and dispensing apparatus 10 of the present invention is in the assembled condition shown in FIGS. 3, 4 and 5.

A plurality of openings or foramina 72 are substantially equally spaced from one another within the face of the nozzle and mixture control member 50. The foramina 72 define the locus of a circle a given radial distance outward from the center of the member 50 which is equal to the radius of a circle the circumference of which would intersect the centers of the two circumferentially located blocking members 58 (see FIGS. 3 and 5).

At the locations on the face of the member 50 where the blocking members 58 appear, there are no foramina 72 within the face of the member 50 as may be best seen by reference to FIGS. 3 and 5. The locus of the circle which the foramina 72 define is complete with the exception of the lack of foramina at the location of the blocking members 58.

As may be seen by reference to FIG. 4, the blocking members 58 extend axially upstream a distance which is substantially equal to the upstream axial extent of the shoulder 56 of the cylindrical mounting hub 52. Consequently, when the combined shower head and dispensing apparatus 10 is in the assembled condition as shown in FIGS. 3, 4 and 5 with the mounting or assembly rod 36 inserted through the opening 64 within the nozzle and mixture control member 50, through the opening 34 within the cap member 28 and threadably received within the opening in the upstream mounting projection 68, the shoulder 56 of the cylindrical mounting hub 52 abuts the downstream face of the cap member 28. In virtue of the substantially equal upstream radial extent of the shoulder 56 and the end face of the blocking members 58, the blocking members 58 likewise abut the downstream face of the cap member 28 for a purpose to be described in detail hereinafter.

Spaced radially outward from the foramina 72 within the face of the nozzle and mixture control member 50, are a plurality of foramina 74 which define the locus of a circle which is concentric with the locus of the circle described by the foramina 72.

As may be noted by reference to FIG. 4, the configuration and location of the enlarged diameter portion of the mounting hub 52, the upstream end of the face of the nozzle and mixture control member 50 within which the foramina 72, 74 appear and the interior of the mounting flange 54, form a mixing chamber 76 with the downstream face of the cap member 28 when the shower head and dispensing apparatus 10 is in the assembled condition as shown most clearly in FIG. 4. The function and operation of the mixing chamber 76 will be discussed in greater detail hereinafter. However, as may be seen by reference to FIG. 4, the foramina 72, 74 communicate at their upstream ends with the interior of the mixing chamber 76 and, at their downstream ends, with the exterior of the shower head and dispensing apparatus 10.

As may be most clearly seen by reference to FIGS. 4 and 6, the upstream end wall 18 includes therein, above the dividing wall 24, a single, additive chamber fluid inlet port 78 which communicates the interior of the fluid inlet member 14 with the interior of the additive chamber 20.

Also located within the upstream end wall 18, below the dividing wall 24, are three fluid chamber inlet ports 80 which communicate the interior of the fluid inlet member 14 with the interior of the fluid chamber 22. As may be seen by reference to FIGS. 4 and 6, the fluid chamber inlet ports 80 are substantially larger in diameter than is the additive chamber fluid inlet port 78.

A generally cylindrical opening 82 appears within the upper portion of the main body member 12 and communicates the interior of the additive chamber 20 with the exterior of the shower head and dispensing apparatus 10. A generally cylindrical upstanding projection 84 projects radially outwardly from the main body member 12 and includes a flange 86 about the upper radially outermost part thereof for a purpose to be described. A generally circular additive chamber access cover 88, which includes a projecting tab 90 fixed thereto, also includes a generally cylindrical recess therein at least partially defined by a lip 92. The recess is configured and sized to removably engage the flange 86 for sealing the cover 88 over the opening 82. The cover 88 also includes a rear projection 96 fixed thereto which is attached at one end to the cover 88 and at the other end to a generally cylindrical mounting axle 98 journaled within bearing 100 fixed to the exterior of the main body member 12.

In operation, the shower head and dispensing apparatus 10 is, in its assembled condition as shown in FIG. 4, placed with the interior of the fluid inlet member 14 in communication with a source of supply of fluid to be dispensed therefrom (such as water) by being connected thereto by the use of a standard shower head coupling member S. After attachment of the combined shower head and dispensing apparatus 10 to the source of supply of fluid, or before such attachment, the cover 88 which closes the communication between the exterior of the main body member 12 and the interior of the additive chamber 20 through the opening 82 is lifted by use of the tab 90 and pivots about the axle 98. An additive is then introduced into the additive chamber 20 through the opening 82. The additive may be, as noted hereinbefore, a water softener or a soap, perfume, oil or emollient. The additive may be in any desired form such as solid, granular or liquid as long as it is sized to pass through the opening 82 into the additive chamber 20. If desired, the opening 82 may be shaped in a particular configuration such as star-shaped and corresponding star-shaped solid, additive tablets may be provided.

The cover 88 is then pivoted about the axle 98 and closed thereby effectively sealing the additive chamber 20 from the exterior of the main body member 12 through the opening 82. Typically, the water or other fluid supply in communication with the interior of the combined shower head and dispensing apparatus 10 through the fluid inlet member 14 is turned on through the use of valves of standard design not forming part of the subject invention. Upon entry of the water into the interior of the fluid inlet member, it travels through the additive chamber inlet port 78 and enters the additive chamber 20. If the blocking members 58 are not in the "blocking" position shown in FIGS. 3 and 4, the water which enters the additive chamber 20 substantially fills the chamber 20 and either dissolves or mixes with the additive material therein and exits the additive chamber through the additive chamber exit ports or orifices 44 and passes into the mixing chamber 78. An additive path is thereby established, generally indicated by the directional arrows A, from the fluid inlet member through the additive chamber inlet port 78 through the additive chamber 20 and into the mixing chamber 76.

At the same time as the water or other fluid has entered the additive chamber 20, water or other fluid enters from the interior of the fluid inlet member 14 into the fluid chamber 22 through the fluid chamber inlet ports or orifices 80. As noted hereinbefore, the fluid chamber inlet orifices 80 are each substantially larger in diameter than is the additive chamber inlet orifice 78. In addition, there is only a single additive chamber inlet orifice 78 while there are three fluid chamber inlet orifices or ports 80 shown in the preferred embodiment. Consequently, the volume of fluid which enters the fluid chamber 22 is far greater than the volume of fluid which can enter the additive chamber 20.

Further, the additive chamber 20 is, as may be seen by reference to FIGS. 1 and 4, smaller in size than is the fluid chamber 22. The water which enters the fluid chamber 22 at the upstream end thereof through the orifices 80 substantially completely fills the fluid chamber 22 and exits therefrom at the downstream end through the fluid chamber outlet ports or orifices 42 into the mixing chamber 76 formed by the upstream face of the nozzle and mixture control member 50, bounded partially by the interior of the flange 54 and the downstream face of the cap member 28.

In virtue of the relative radial location of the fluid chamber exit ports 42 and the non-alignment thereof with the foramina 72, 74 and in virtue of the radial location of the additive chamber exit ports 44 and the lack of the axial alignment thereof with the foramina 72, 74 both the fluid exiting from the downstream end of the fluid chamber and the combination of fluid and additive exiting from the downstream end of the additive chamber enter the mixing chamber and are forced to thoroughly mix one with the other prior to the completely combined mixture exiting from the foramina 72, 74 to thereby be discharged to the exterior of the combined shower head and dispensing apparatus 10.

As may be noted by reference to FIG. 4, a fluid path is established by the apparatus of the subject invention from the interior of the fluid inlet member 14, through the fluid chamber inlet ports 80 through the interior of the fluid chamber 22, exiting from the fluid chamber through the downstream exit ports 42 into the mixing chamber 76.

The nozzle and mixture control member 50 may be rotated relative to the relatively fixed cap member 28 to the "normal" position shown in FIG. 5. In the "normal" position, the blocking members 58 which abut the downstream face of the cap member 28 (see FIG. 5), unblock the additive chamber exit ports 44 and flow of the additive fluid mixture along the additive path generally designated by the reference letter A continues through the additive chamber 20 into the mixing chamber 76. In this "normal" position, the radially inwardly projecting ear 60 abuts the stop 48 as may be seen by reference to FIG. 5, thereby preventing further, 360°rotation of the rotatably mounted nozzle and mixture control member 50.

When it is desired to substantially completely stop the flow of additive from the additive chamber 20, the ridged operating collar 62 is gripped by a user of the subject device and rotated in a counterclockwise direction as viewed from the right. The ear 60, which is fixed to the interior of the nozzle and mixture control member 50 rotates as well until it abuts the right-most end of the stop 46 as seen most clearly in FIG. 3. In the blocking position of the nozzle and mixture control member 50 shown in FIGS. 3 and 4, the upstream ends of the blocking members 58 are rotated into the additive path and, in virtue of the abutting relation of the upstream ends of the blocking members 58 relative to the downstream face of the cap member 28 and the axial alignment thereof with the additive chamber exit ports 44, passage of additive and fluid through the downstream additive chamber exit ports 44 is substantially completely prevented.

The size, configuration and position of the stop 46 and the ear 60 as well as the substantially larger diameter of the blocking members 58 with respect to the additive chamber exit port openings 44 permits rapid repeatable and reliable cutoff of the flow of additive without the need for a user of the subject apparatus having to precisely position the valve members formed from the apparatus described. The interruption of flow of additive is therefore accomplished by merely rotating the nozzle and mixture control member 50 counterclockwise as viewed from the right until the ear 60 abuts the right-most end of the stop 46.

As may be noted by reference to FIG. 4, the fluid path described hereinbefore and generally indicated by reference to directional arrows B in FIG. 4 is always open or established. Consequently, as long as the aforementioned valves controlling the supply of fluid to the shower head and dispensing apparatus 10 are supplying fluid thereto through the fluid inlet member 14, the water or other fluid supplied will continually enter the fluid inlet chamber flow along the fluid path into the mixing chamber 76 and exit or be dispensed from the apparatus 10 through the foramina 72, 74.

It is only when it is desired or necessary to supply additive from the additive chamber 20 into the plurality of streams exiting from the foramina 72, 74 that the rotatable nozzle and mixture control member 50 need be rotated from the blocking position shown in FIGS. 3 and 4 to the normal position shown in FIG. 5. When this occurs, as noted hereinbefore, the turbulence within the mixing chamber 76 owing to the apparatus described results in a thorough mixing of the additive supplied from the additive chamber with the fluid supplied from the fluid chamber so that the plurality of streams of fluid which exit from the foramina 72, 74 all contain substantially equal amounts of additive.

In view of the generally longitudinal arrangement of the additive chamber 20 and the alignment thereof in a longitudinal direction with the direction of the additive path A, and in view of the relatively small size of the additive chamber inlet port 78, a fairly large amount of turbulence is created within the additive chamber 20 which aids in proper mixture of the incoming water or other fluid with the additive contained within the additive chamber.

Further, the relatively small size of the downstream additive chamber exit ports 44 cause the exiting mixture of additive and fluid to turbulently enter the mixing chamber 76 thereby further facilitating complete mixture of the additive with the fluid entering the mixing chamber 76 from the fluid chamber 22 through the downstream fluid chamber exit ports 42. All of this turbulence within the mixing chamber 76 aids in the provision, to the plurality of streams exiting from the apparatus 10 through the foramina 72, 74, of substantially equal amounts of additive.

The generally parallel longitudinal arrangement of the additive and fluid chambers 20, 22 permits effective continuous supply of pure fluid from the fluid chamber 22 with effective addition, when desired or required, of additive from the additive chamber 20 to the mixing chamber 76.

In virtue of the non-alignment of the exit ports 44, 42 from the downstream ends of the additive and fluid chambers 20, 22, respectively, with any of the exit foramina 74 and the nonalignment with the majority of the exit foramina 72 as well as the generally transverse arrangement of the mixing chamber 76 relative to the additive and fluid chambers 20, 22, a significant amount of turbulence within the mixing chamber 76 results, thereby facilitating complete mixture of the fluid with the additive when the same is discharged uniformly in the plurality of streams which exit from the subject apparatus through the foramina 72, 74.

It is to be understood throughout this application that when the word "fluid" is used in general and as noted hereinbefore, it is meant to refer to the fluid supplied the apparatus 10 through the fluid inlet member 14. Typically, this fluid would be water. It is also to be understood that when the term additive is used in this application, it is used to indicate, depending upon the context, either additive material by itself such as liquid additives being introduced into the additive chamber 20, or a mixture of additive and fluid exiting from additive chamber 20.

As will be readily apparent to those skilled in the art, the invention may be used in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalents of the claims are therefore intended to be embraced therein.

What is claimed is:

1. An apparatus for producing a plurality of streams of fluid from a supply of fluid and for selectively introducing a substantially equal amount of additive into each of said streams of fluid, said apparatus comprising a main body member having an upstream end and a downstream end, a fluid inlet member and means mounting said fluid inlet member on said main body member at said upstream end thereof, said fluid inlet member including means being constructed and arranged for attachment of said apparatus to a source of supply of fluid, a fluid chamber located within said main body member and having an upstream end and a downstream end, an additive chamber located within said main body member and having an upsteam end and a downstream end, an axially extending dividing wall within said main body member at least partially defining said additive chamber and said fluid chamber, said upstream end of said fluid chamber and said upstream end of said additive chamber each being in communication with the interior of said fluid inlet member, an access member being mounted relative to said main body member and including means being constructed and arranged to permit communication with the interior of said additive chamber from the exterior of said main body member for use in introducing an additive through said access member into said additive chamber, a foraminous member mounted relative to said main body member proximate the downstream end thereof for use in producing said plurality of streams of fluid, said fluid chamber and said additive chamber each including at least one opening in the downstream end thereof, said apparatus including a mixing chamber proximate the downstream end of said main body member, said mixing chamber being in communication with said additive chamber and said fluid chamber through, respectively, said additive chamber and fluid chamber downstream end openings, said mixing chamber also being in communication with said foraminous member, said apparatus including means being constructed and arranged to define a fluid path from said fluid inlet member through said fluid chamber and into said mixing chamber, said apparatus further including means being constructed and arranged to define an additive path from said fluid inlet member through said additive chamber and into said mixing chamber, said apparatus including means being constructed and arranged to thoroughly mix said fluid and said additive in said mixing chamber and said apparatus further including additive control means located in said additive path for selectively interrupting the flow of additive from said additive chamber along said additive path thereby selectively permitting passage of substantially only said fluid through said foraminous member and selectively permitting passage of a thoroughly dispersed mixture of said additive and said fluid through said foraminous member, a cap member mounted within said main body member so as to be relatively stationary with respect thereto and including means being constructed and arranged for at least partially closing the downstream end of both said fluid chamber and said additive chamber, said cap member including at least one fluid chamber exit port having an upstream end and a downstream end, said fluid chamber exit port being constructed and arranged to communicate at its upstream end with the downstream end of said fluid chamber and at its downstream end with said mixing chamber, said cap member further including at least one additive chamber exit port having an upstream end and a downstream end, said additive chamber exit port being constructed and arranged to communicate at its upstream end with the downstream end of said additive chamber and at its downstream end with said mixing chamber.

2. The invention according to claim 1, said cap member having an upstream side in communication with said additive chamber and said fluid chamber and having a downstream side in communication with said mixing chamber, at least two axially downstream-extending circumferentially spaced stop members being mounted on the downstream side of said cap member, said additive control means including at least one blocking member extending axially upstream from an upstream side of said foraminous member, said upstream side of said foraminous member being in communication with said mixing chamber and said foraminous member being rotatably mounted relative to said apparatus, said foraminous member being rotatable so as to move said blocking member between a blocking position wherein said blocking member blocks passage of said additive through said additive chamber exit port and a normal position wherein said blocking member does not block passage of said additive through said additive chamber exit port, a radially inwardly extending ear fixed to said upstream side of said foraminous member, said ear, said stop members and said blocking member all being constructed and arranged to position said blocking member to block the flow of said additive through said additive chamber exit port upon said foraminous member being rotated to said blocking position and being further constructed and arranged to position said blocking member not to block the flow of said additive through said additive chamber exit port upon said foraminous member being rotated to said normal position.

* * * * *